US005468164A

United States Patent [19]

Demissy

[11] Patent Number: 5,468,164

[45] Date of Patent: Nov. 21, 1995

[54] FEMALE CONTACT, IN PARTICULAR FOR A HIGH TENSION SECTION SWITCH

[75] Inventor: Daniel Demissy, Montreal, Canada

[73] Assignee: GEC Alsthom T & D, Inc., La Praire, Canada

[21] Appl. No.: 293,224

[22] Filed: Aug. 19, 1994

[30] Foreign Application Priority Data

Aug. 20, 1993 [FR] France ..... 93 10148

[51] Int. Cl.[6] ..... H01R 13/187

[52] U.S. Cl. ..... 439/843; 439/821; 439/840; 439/839

[58] Field of Search ..... 439/843, 842, 439/851–856, 799, 840, 839, 833, 821

[56] References Cited

U.S. PATENT DOCUMENTS 4,534,610 8/1985 Takihara ..... 439/839
4,550,972 11/1985 Romak ..... 439/839
4,993,526 1/1985 Masuda ..... 439/839
5,007,865 4/1991 Jakobeit ..... 439/839

FOREIGN PATENT DOCUMENTS 2310129 9/1974 Germany .
2935202A1 3/1981 Germany .

*Primary Examiner*—David L. Pirlot
*Attorney, Agent, or Firm*—Sughrue, Mion, Zinn, Macpeak & Seas

[57] ABSTRACT

A female contact, in particular for a high tension section switch, the female contact comprising two interleaved thimbles, a metal first thimble made by extruding a block of metal and then machining it, said first thimble having metal contact fingers designed for co-operating electrically with a male contact, the other thimble including fingers of an insulating material, the insulating fingers limiting the displacement of the metal contact fingers in a radial direction and in a lateral direction to predetermined values that are less than the elastic limit of deformation of the metal contact fingers, and serving in particular to prevent contact between the metal contact fingers.

7 Claims, 5 Drawing Sheets

FEMALE CONTACT, IN PARTICULAR FOR A HIGH TENSION SECTION SWITCH

FIELD OF THE INVENTION

The present invention relates to a female electric contact of the type comprising a plurality of resilient metal fingers disposed parallel to one another along the generator lines of a cylinder in a configuration that may be referred to as a contact "thimble". Such a contact is designed to co-operate with a male contact constituted by a tube or a rod that is cylindrical, coaxial with the female contact, and capable of moving coaxially. Such male and female contacts are used in equipment for high tension section switches.

Such thimble-type female contacts already exist, and a particular embodiment is described in document FR-A-92/05 689.

OBJECTS AND SUMMARY OF THE INVENTION

A first object of the invention is to provide a female contact in which, in the event of a short circuit, the fingers that are then subjected to a very large electrodynamic force do not deform in radial planes beyond their elastic limit.

Another object of the invention is to provide a female contact in which the contact force is the same for each of the fingers of the thimble, even if the male contact penetrates in such a manner that its axis is offset.

Another object of the invention is to provide a female contact in which the lateral deformation of the fingers due to the electric forces that act on the parallel fingers is limited and does not exceed the elastic limit of deformation.

Another object of the invention is to provide a female contact in which the stiffness of the contact fingers is set by construction, by means of a machining method that is simple.

Another object of the invention is to provide a female contact in which, in the event of a short circuit, all risk is eliminated of the fingers welding together and of the pressure spring that surrounds the contact fingers burning.

These objects are achieved by the female contact of the invention which comprises two interleaved thimbles, a metal first thimble made by extruding a block of metal and then machining it, said first thimble having metal contact fingers designed for co-operating electrically with a male contact, the other thimble including fingers of an insulating material, the insulating fingers limiting the displacement of the metal contact fingers in a radial direction and in a lateral direction to predetermined values that are less than the elastic limit of deformation of the metal contact fingers, and serving in particular to prevent contact between the metal contact fingers.

BRIEF DESCRIPTION OF THE DRAWINGS

The invention is explained below in detail by describing a preferred embodiment with reference to the accompanying drawings, in which.

MORE DETAILED DESCRIPTION

As already mentioned, the female contact of the invention comprises two interleaved thimbles: a conductive thimble; and an insulating thimble.

The figures show the conductive thimble.

It is made by extruding a block of aluminum 1, followed by a machining operation.

Extrusion makes it possible to implement fingers 2 of a section that is substantially rectangular with rounded edges, having large face provided with a flat-topped radial ridge 2A of height Y.

The height Y is selected as a function of the length X of the finger for obtaining the stiffness desired for the contact finger.

The ridge 2A extends from the base of the finger along the entire length of the finger with the exception of the end of the finger. The flat portion of the end of the finger has a pellet 3 fixed thereto which is made of a material that withstands wear and the effects of arcing, so as to present an inwardly directed projection 3A for co-operating electrically with the male contact.

The base of the block is machined to have a groove 4 of a depth that enables the length X of the fingers to be adjusted.

Figure 1:
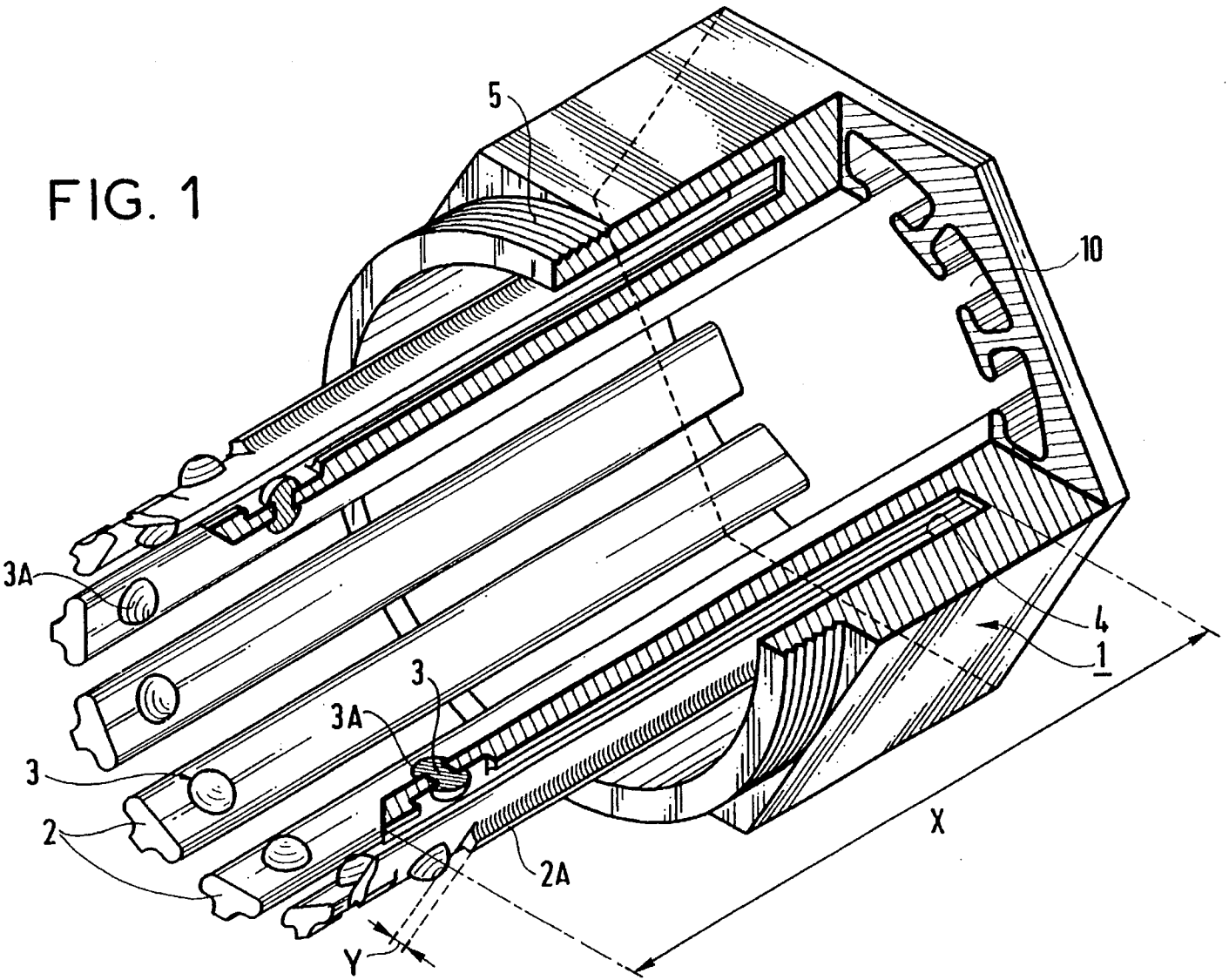
FIG. 1 is a partially cutaway perspective view of a metal thimble constituting a female contact element of the invention.
Figure 2:
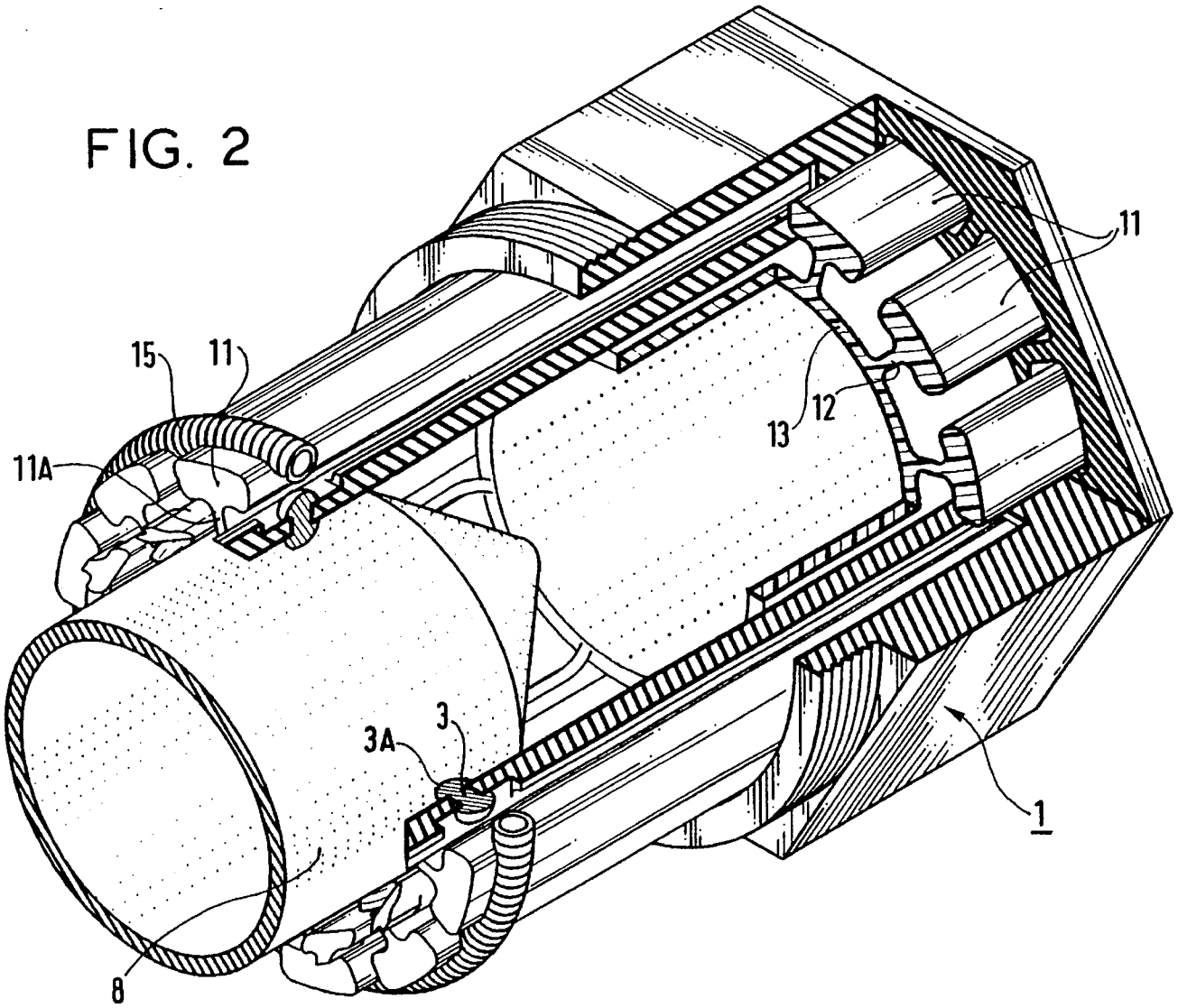
FIG. 2 is a partially cutaway perspective view showing, in particular, the insulating thimble interleaved within the metal thimble.
Figure 3:
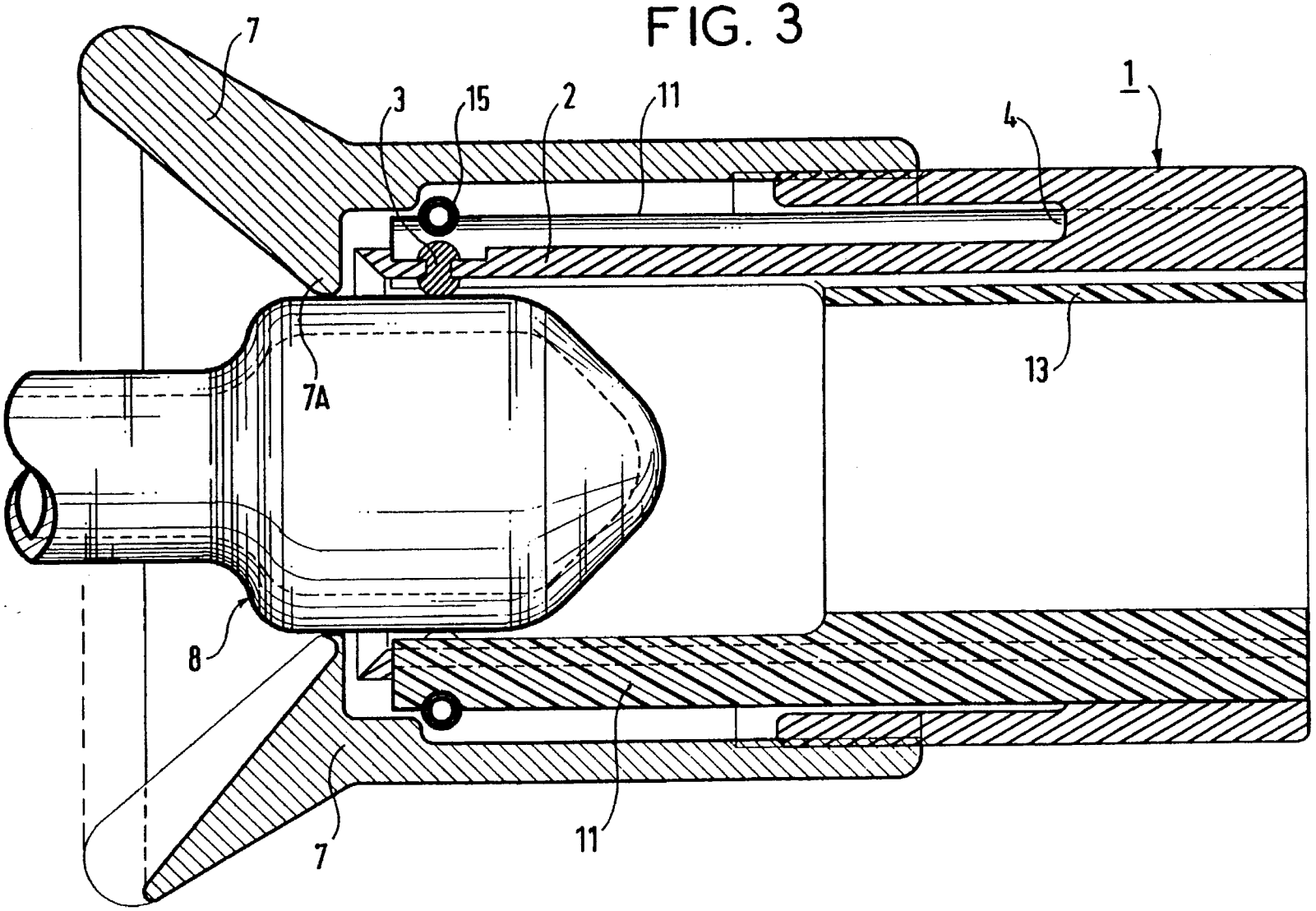
FIG. 3 is an axial section view through the contact of the invention, shown co-operating with an associated male contact.
Figure 4:
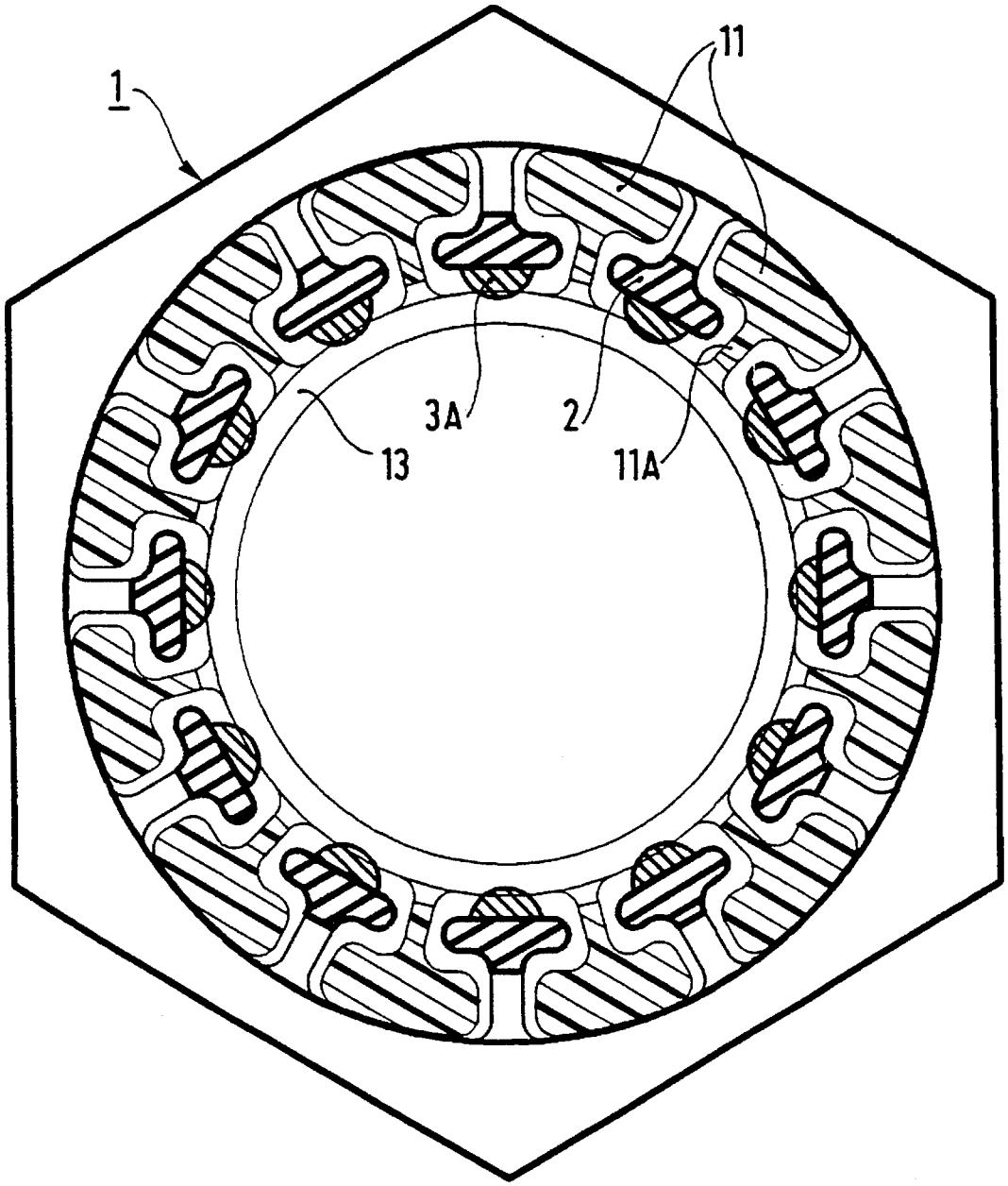
FIG. 4 is a cross-section view through a contact of the invention that does not include a spring.
Figure 5:
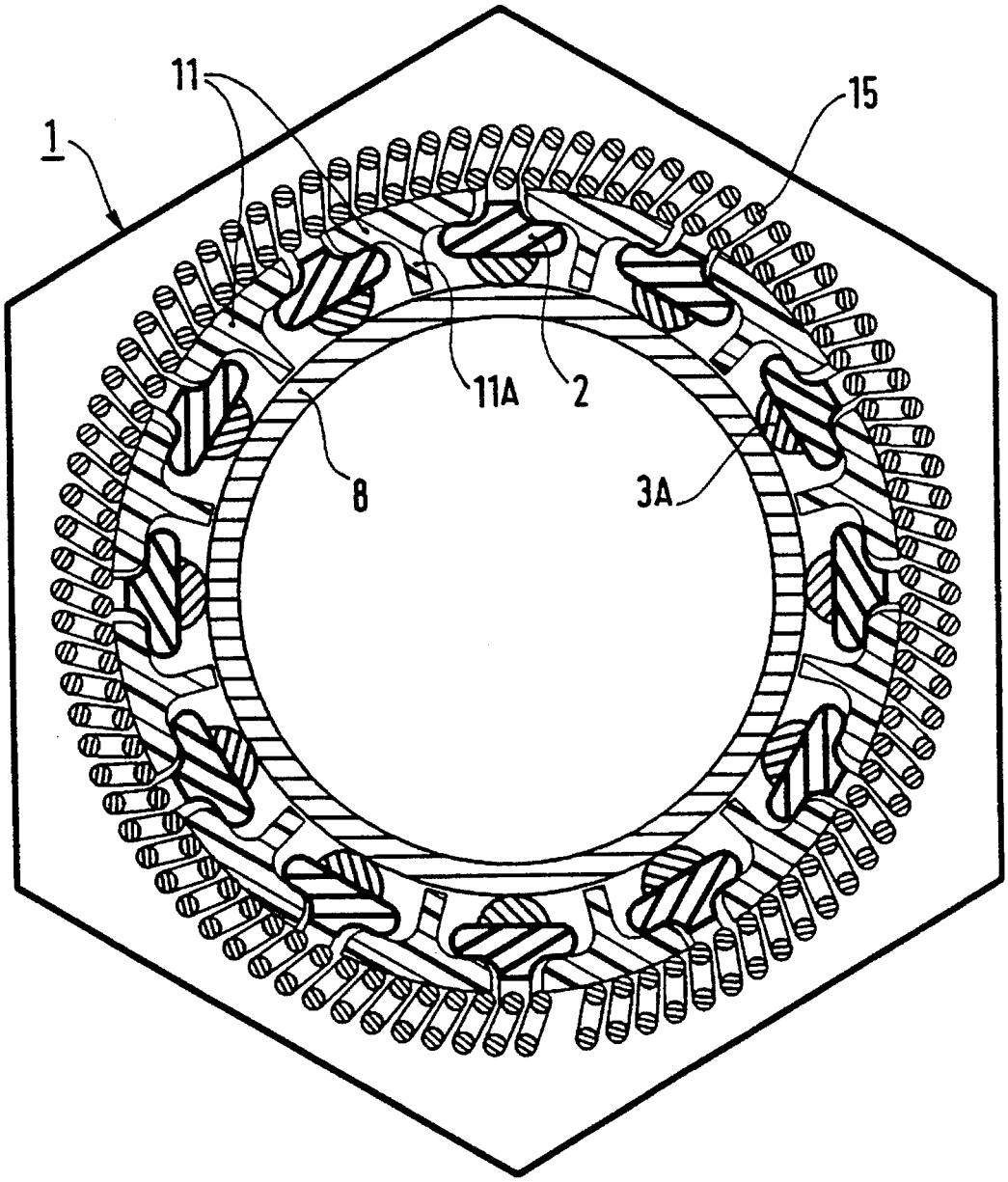
FIG. 5 is a cross-section view through a female contact of the invention that is provided with a spring, the male contact being shown engaged.

The base of the block comprises a threaded portion 5 enabling a centering cone 7 to be screwed thereon for the purpose of centering the male contact 8 (see FIG. 3). The cone 7 is provided with ice-breaking spurs 7A.

At the base of the block 1, the extrusion operation has made it possible to define spaces 10 between each of the fingers, in which spaces there is engaged a thimble of insulating material made by molding or by extrusion followed by machining, and comprising a plurality of fingers 11 that are united via bridges 12 with a cylindrical portion 13. The insulating material may be selected, for example, from substances known under the trademarks Teflon or Nylatron GSM, where Nylatron GSM is a high-strength type 6 nylon filled with molybdenum bisulfide and one of whose characteristics is that it does not burn.

The section of the fingers 11 is substantially rectangular with rounded edges. The insulating fingers 11 are of the same length as the metal fingers 2. The cylindrical portion 13 stops substantially level with the thread 5. Between the end of the cylindrical portion 13 and the ends of the fingers 11, the bridges 12 define flat-topped ridges 11A.

The female contact as described above solves the technical problems specified in the preamble of the present specification.

In the event of a short circuit, radial displacement of the contact fingers 2 is limited to a value that lies within their elastic limit because of the presence of the insulating fingers 11 which prevents the metal fingers being subjected to plastic deformation. The insulating fingers prevent any contact between the metal fingers and an outer metal envelope, and therefore prevent them being burnt by any possible destructive shunt currents.

The lateral displacement of the contact fingers 2 due to the electromagnetic forces that are exerted on the parallel conductors is limited by the presence of the interleaved insulating fingers 11, thereby avoiding any risk of permanent deformation due to the elastic limit being exceeded.

The presence of the insulating thimble makes it possible to ensure contact that is substantially uniform between the male contact and each of the pellets 3, even if the male contact is presented with its axis offset.

Not only do the insulating fingers limit bending of the metal fingers, they also keep them insulated from one another, thereby avoiding problems of two parallel fingers that have been deformed by the effect of a short circuit welding together (the effect whereby parallel currents move towards each other, which effects become significant from about 80 kA for 1 second and 216 kA peak asymmetrical for 10 cycles).

It should be observed that burning or welding of the fingers occurs when the shock of the short circuit causes the fingers to move, thereby increasing contact resistance at the point of transfer and tending to provoke a temperature rise which may be sufficient to melt copper.

The female contact may be provided with a circular spring 15 to increase the contact pressure of the metal thimble. The use of such a spring for the abovementioned purpose is a technique well known to the person skilled in the art. However, springs which are directly in contact with the metal fingers can themselves be subject to shunt currents due to dynamic or thermal shocks during a short circuit in the event of one or more fingers not being firmly in contact with the male contact.

In the present invention, the spring 15 is disposed around the insulating thimble, thereby making it possible to avoid any metallic contact between the spring and the metal contact fingers, with the pressure force of the spring being transmitted through the insulating thimble. The spring is held in place by a groove that is machined in all of the insulating fingers 11.

The invention is applicable in equipment for high tension section switches in which the moving hammer travels axially at the end of a closure stroke.

I claim:

1. A female contact, in particular for a high tension section switch, the female contact comprising two interleaved thimbles, a metal first thimble made by extruding a block of metal and then machining it, said first thimble having metal contact fingers designed for co-operating electrically with a male contact, the other thimble including fingers of an insulating material, the insulating fingers limiting the displacement of the metal contact fingers in a radial direction and in a lateral direction to predetermined values that are less than the elastic limit of deformation of the metal contact fingers, and serving in particular to prevent contact between the metal contact fingers.

2. A female contact according to claim 1, wherein the contact fingers of the metal thimble have a section in the form of a rectangle with rounded edges, and possess a ridge extending over at least a fraction of the length of the finger.

3. A female contact according to claim 1, wherein the fingers of the thimble made of insulating material are of the same length as the metal fingers.

4. A female contact according to claim 1, wherein the insulating fingers are of a section that is substantially rectangular with rounded edges and each possesses a ridge projecting from one of the large faces of the rectangle.

5. A female contact according to claim 1, wherein the length of the contact fingers is adjusted by machining a groove in the extruded metal block.

6. A female contact according to claim 1, wherein the block includes a cylindrical thread designed to have a centering cone provided with ice-breaking spurs screwed thereon to receive the male contact, said cone serving to limit the total deflection of said interleaved thimbles when assembled together.

7. A female contact according to claim 1, including a spring surrounding the insulating fingers and acting through them to impart contact pressure to the metal fingers without electrical continuity being established between the spring and the metal contact fingers.

* * * * *